United States Patent [19]

Speicher

[11] 4,345,580

[45] Aug. 24, 1982

[54] FIREPLACE DAMPER ATTACHMENT

[76] Inventor: Gerald W. Speicher, P.O. Box XX, Santa Rosa, Calif. 95403

[21] Appl. No.: 205,671

[22] Filed: Nov. 10, 1980

[51] Int. Cl.[3] ..... F23L 3/00

[52] U.S. Cl. ..... 126/288; 403/91

[58] Field of Search ..... 126/285 R, 286, 288, 126/295; 403/91, 97, 388, 408, 181; 294/9, 10, 19 R, 24; 16/110 R, 111 R, 114 R, 115

[56] References Cited

U.S. PATENT DOCUMENTS

| | | | |
|---|---|---|---|
| 926,426 | 6/1909 | Koch | 403/97 |
| 1,631,123 | 6/1927 | Guy | 126/288 |
| 1,928,165 | 9/1933 | Boldt | 126/288 |
| 3,094,114 | 6/1963 | Cage | 126/288 |
| 3,773,029 | 11/1973 | Kent | 126/288 |

*Primary Examiner*—James C. Yeung

*Attorney, Agent, or Firm*—Melvin R. Stidham

[57] ABSTRACT

An attachment for a fireplace flue damper, which has an operating arm of flat bar stock steel. A steel channel with serrated edges is placed at any selected angle across the arm and tightened down with a bolt to grip it. A hand grip is placed over the outer end of the channel and disposed at any angle, usually tilted upward to bring it near the top of the fireplace opening when the damper is opened. It, too, is tightened down to grip by friction.

2 Claims, 3 Drawing Figures

FIREPLACE DAMPER ATTACHMENT

BACKGROUND OF THE INVENTION

In most fireplaces, the flue is provided with a short handle for the damper which is not visible from outside the fireplace. Without some visual reminder, it often occurs that the fire is kindled while the damper is closed and, as a result, smoke is expelled out into the room. Then, it is difficult to reach the handle without burning the hand. In any event the handle is usually covered with soot and at best, messy to handle. As a consequence, many people simply leave the damper open at all times. This, of course, results in a loss of energy as heat rises up the fireplace flue.

OBJECTS OF THE INVENTION

It is an object of this invention to provide an attachment for the damper handle of a fireplace which gives a visual indication to one in the room of the position of the damper.

It is a further object of this invention to provide a visual reminder to change the position of the flue damper, depending on whether or not there is to be a fire in the fireplace.

It is a further object of this invention to provide a clean and convenient way of operating a fireplace damper control so as to minimize heat loss and conserve energy.

Other objects and advantages of this invention will become apparent from the description to follow, particularly when read in conjunction with the accompanying drawing.

SUMMARY OF THE INVENTION

In carrying out this invention, I provide a channel member with serrations along its edges to be positioned at any selected angle across the conventional flue damper arm. The serrated channel is firmly secured to the damper arm by a bolt which goes through the existing hole in the damper arm. Hence, in any selected position, there will be a firm interlock between the channel and the damper arm. The channel also has a series of holes along the length of its web so that it can be made to extend any desired amount. A hand grip is likewise bolted to the outer end of the channel so that the damper may be operated from near the vertical plane of the fireplace opening. The hand grip may be disposed at a upward angle with respect to the channel so that it may be disposed up near the top of the fireplace opening although the channel is usually disposed at a downward angle from the damper arm above it.

DESCRIPTION OF A PREFERRED EMBODIMENT

Figure 2:
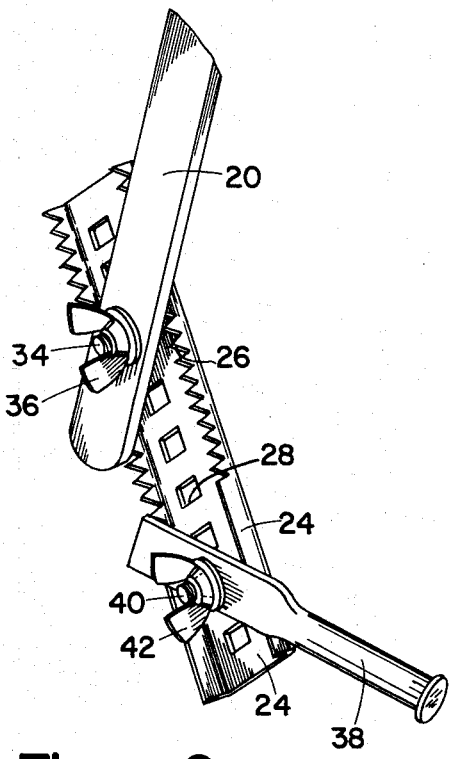
FIG. 2 is a view in perspective showing the fireplace flue attachment of this invention.
Figure 3:
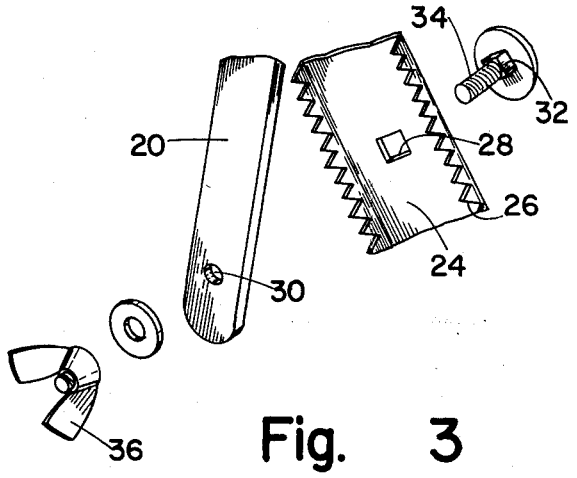
FIG. 3 is a view in perspective showing the method of attaching the assembly.
Figure 1:
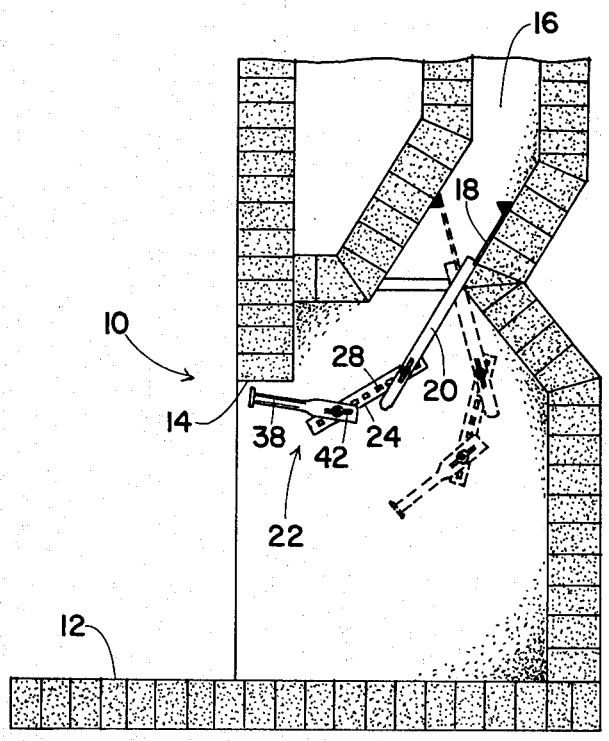
FIG. 1 is a vertical section view through a fireplace showing my attachment in operation.

Referring now to the drawing with greater particularity, there is shown a fireplace 10 with hearth 12, fireplace opening 14, flue 16 and flue damper 18. Welded or otherwise secured to the damper 18 is a damper arm 20 of steel bar stock or the like, which may be grasped to move the damper 18 from the open position shown in solid lines in FIG. 1 to the closed position shown in phantom.

In the attachment 22 of this invention, there is provided a channel member 24, slightly wider than the handle 20 so that it may be nested therein. The channel flanges are serrated at 26 along all or most of the length thereof so that it may be positioned at selected angle across the damper arm 20, wherein the serrations provide a firm grip, or the damper arm may be nested in the channel so that the channel forms a longitudinal extension.

The channel member 24 has a plurality of square holes 28 punched therein along the length thereof, any one of which may be aligned with the hole 30, which is conventionally provided in the damper handle 20. The square hole 28 selected receives the complementary shoulder 32 of a carriage bolt 34, holding it against rotation. Hence, by selecting one of a series of length adjustment holes 28, the outward extension, as well as the angle of the channel member 24, may be adjusted. The channel extension 24 is secured in place by tightening a wing nut 36 or the like against the arm 20.

The hand grip 38 may be disposed at any angle with respect to the channel 24, in order to bring it to a desired location with respect to the top of the fireplace opening 14. By disposing it an upward angle as indicated it could be positioned closely adjacent to the top of the fireplace opening 14 despite the fact that the channel 24 would normally be angled downward from the damper arm 20 disposed above the fireplace opening 14. Hence, when the flue damper 18 is open, as it must be when the fireplace is in use, the hand grip 38 is disposed in the fireplace opening out of the path of rising smoke. Accordingly, besides giving visual notice that the damper 18 is open, the hand grip 38 remains clean.

When the hand grip 38 is positioned as desired, a similar carriage bolt 40 is inserted through an appropriate square opening 28 and a wing nut 42 tightened to grip the channel flanges **24*a*** by friction.

In use, it will become readily apparent to the homeowner or tenant that when the handle 38 is visible at the top of the fireplace opening 14, the flue damper 18 is open, and that when it is not, the damper is closed. When one wishes to kindle a fire, the hand grip 38 is conveniently located, and may easily be pulled forward to open the flue without requiring one to stoop, reach or soil his hands.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention is:

1. An attachment for a fireplace flue damper having a handle of flat bar stock metal with a first hole therethrough, said handle being disposed to swing through the fore and aft plane of a face thereof to adjust said damper; said attachment comprising:

a rectangular elongated channel defined by opposite side walls and a web joining said side walls adapted to be disposed across a face of said damper handle at a selected angle along said plane, with the edges of said side walls in engagement therewith;

a plurality of square adjustment holes along the web of said channel;

a carriage bolt nested in and extending through a selected one of said adjustment holes and said first hole so that the end of said channel is disposed at a desired height in the fireplace opening when the damper is in open position;

a force-applying wing nut threaded onto said carriage bolt said side wall edges being serrated to grip said flat bar handle at any location thereof when force is applied thereto and a hand grip secured to the other end of said channel.

2. The attachment defined by claim 1 wherein:

said hand grip is disposed at a desired angle with respect to said channel; and bolt means securing said hand grip tightly to the edges of said side walls.

* * * * *